United States Patent [19]

Suzuki

[11] 4,177,943

[45] Dec. 11, 1979

[54] REFRACTORY RELEASING AGENT

[75] Inventor: Hiroyuki Suzuki, Tokyo, Japan

[73] Assignee: Daishin Kako Co., Ltd., Tokyo, Japan

[21] Appl. No.: 813,873

[22] Filed: Jul. 8, 1977

[51] Int. Cl.[2] ..... B22D 41/02; B22D 41/08

[52] U.S. Cl. ..... 222/591; 266/272

[58] Field of Search ..... 106/38.23, 38.28; 222/590, 591, 566, 567; 266/271, 272

[56] References Cited

U.S. PATENT DOCUMENTS

| | | | |
|---|---|---|---|
| 1,517,778 | 12/1924 | Frohman | 106/38.23 |
| 2,641,525 | 6/1953 | Walter et al. | 106/38.23 |
| 2,798,817 | 7/1957 | Lund | 106/38.23 |
| 2,961,722 | 11/1960 | Lilljekvist et al. | 222/591 X |
| 3,179,523 | 4/1965 | Morén | 106/38.23 UX |

*Primary Examiner*—David A. Scherbel

*Attorney, Agent, or Firm*—Merchant, Gould, Smith, Edell, Welter & Schmidt

[57] ABSTRACT

A releasing agent of a refractory nozzle fitted to the outlet of a molten metal, comprising graphite powder in an amount sufficient for imparting lubricity to the releasing agent, water and certain kinds of polysaccharide soluble in water and capable of gelatinizing the releasing agent. The polysaccharide is dissolved in water in an amount sufficient for gelatinizing the releasing agent and imparting adhesiveness and coating capability to the releasing agent.

4 Claims, 2 Drawing Figures

REFRACTORY RELEASING AGENT

This invention relates to a refractory releasing agent, and more particularly to a releasing agent of a refractory nozzle fitted to the outlet of a molten metal ladle constituted by a refractory body.

In general, a nozzle made of refractory bricks is fitted to the outlet of a ladle where a molten metal such as molten iron is poured from the ladle into a mold. The nozzle is intended to allow the molten metal to be poured into the mold under predetermined conditions and tends to have its inner wall abraded after repeated use, rendering it necessary to replace the nozzle. However, it is customary to fit a nozzle of this type to the outlet of a ladle using, for example, a high alumina content cement mortar. Thus, it is very laborious to take out the nozzle for the replacement. For example, about 5 kg–10 kg/cm$^2$ of pulling force is required for taking out the nozzle. Naturally, the time required for the replacement work is considerably long.

Attempts have been made to add carbon black to the mortar in order to facilitate taking out the nozzle, obtaining unsatisfactory results.

An object of this invention is to provide a releasing agent permitting relatively easily taking out a refractory nozzle fitted to the outlet of a molten metal ladle constituted by a refractory body.

According to this invention there is provided a releasing agent of a refractory nozzle fitted to the outlet of a molten metal ladle, comprising graphite powder in an amount sufficient for imparting lubricity to the releasing agent, water and at least one kind of water-soluble and gelatinizable polysaccharide dissolved in the water in an amount sufficient for gelatinizing the releasing agent so as to impart coating capability and adhesiveness to the releasing agent.

Figure 1:
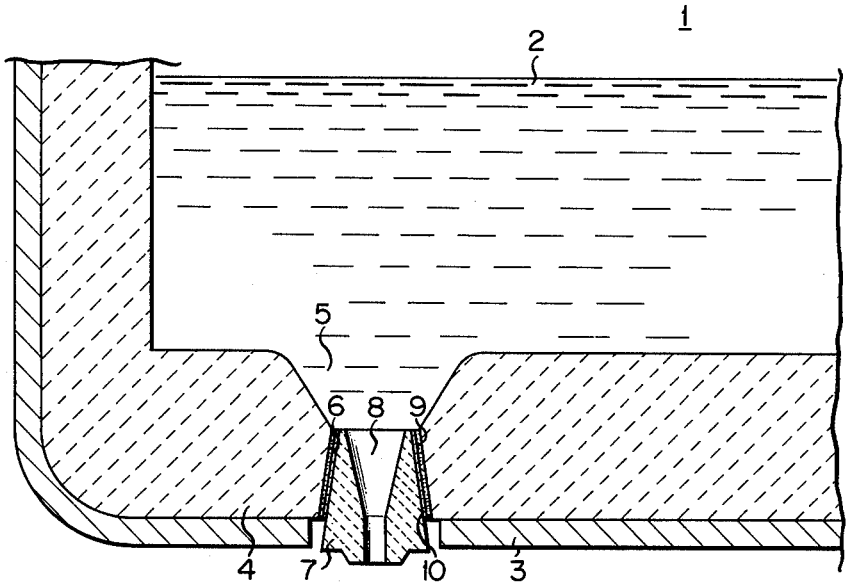
Figure 2:
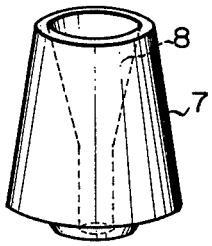

This invention can be more fully understood from the following detailed description when taken in conjunction with the accompanying drawings, in which:

FIG. 1 is a cross sectional view showing a nozzle fitted to the outlet of a ladle; and FIG. 2 is an oblique view showing the nozzle of FIG. 1.

As mentioned previously, the releasing agent of this invention contains powder of graphite, which exhibits a lubricating function owing to its stratified crystal structure. Generally, the particle size of the graphite is not critical as far as the graphite is powdery. But, a preferred particle size ranges from about 1$\mu$ to about 10$\mu$, particularly, from 3$\mu$ to 7$\mu$.

The graphite powder is present in an amount sufficient for imparting lubricity to the releasing agent. In general, the required amount of graphite powder falls within the range of from about 10% to about 60% by weight based on the total amount of the releasing agent. The graphite powder below 10% by weight fails to impart a sufficient lubricity to the resultant releasing agent. On the other hand, the value exceeding 60% by weight causes the releasing agent to lose its adhesiveness. A preferred amount of graphite powder ranges from 15% to 25%.

The second component of the releasing agent of this invention is water. The amount of water is specified to be the balance; namely, the amounts of graphite powder and later-described polysaccharide and other additives are subtracted from the total amount of the releasing agent and the balance is specified as the amount of water.

The polysaccharide used in the releasing agent of this invention should be soluble in water and capable of gelatinizing the releasing agent. Typical examples of the polysaccharide suitable for this invention include starch such as those derived from potatoes, sweet potatoes, corns, wheats and cassavas, cellulose and a modified cellulose such as carboxymethyl cellulose (CMC). Particularly preferred is a starch.

The polysaccharide is dissolved in the second component of water and enables the releasing agent to be adhesive and suitable as a coating material. In general, the amount of polysaccharide ranges from about 0.5% to about 20% by weight of the total amount of the releasing agent. If the amount does not reach 0.5, the releasing agent is not sufficiently adhesive. On the other hand, the polysaccharide exceeding 20% leads to an unsatisfactory fluidity of the releasing agent, failing to provide a good coating material. A preferred amount of polysaccharide falls within the range of from 1% to 4% by weight.

Although the releasing agent of this invention may consist of the above three components, it can also contain additional components as required, such as a dispersing agent like sodium nitrate, an anti-rotting agent like formaldehyde, an anti-icing agent such as sodium chloride and the like. The amount of these additives may be adjusted appropriately and does not exceed in general about 3% by weight based on the total amount of the releasing agent.

It is possible to prepare the releasing agent of this invention by various processes. One convenient process is to dissolve polysaccharide in water in gelatinization, followed by adding graphite powder to the gelatinized solution and subsequent mixing of the mixture. Heating at, for example, 60°–180° C., will be necessary for making a well pasted polysaccharide. The releasing agent thus prepared exhibits in general about 10 cps to about 10,000 cps, preferably 100 cps to 5,000 cps of viscosity at 20° C.

FIGS. 1 and 2 are intended to explain how to use the releasing agent of this invention. FIG. 1 is a sketch around an outlet 5 of a ladle 1 of, for example, molten iron 2. It is seen that a bottom block 4 of refractory bricks having a high alumina content is mounted on a bottom shell 3 of iron. The bottom block 4 is provided with an outlet 5 through which the molten iron is poured into a mold (not shown), and a bore 6 integral with the outlet 5 and for receiving a top nozzle. It is customary in the prior art of fix a top nozzle 7 of, for example, a truncated cone shape having a passageway 8 of the molten iron 2 as shown in FIG. 2 to the bore 4 with mortar of high alumina content used as the bonding agent.

In this invention, however, a releasing agent 9 is coated on the inner wall of the nozzle-receiving bore 6 to a thickness of 1 mm to 2 mm. The coating can be performed by brushing or spraying. On the other hand, the outer circumference of the top nozzle 7 is coated with, for example, a cement mortar having a high alumina content to a thickness of 3 mm to 4 mm.

The total thickness of coated releasing agent and mortar depends on the clearance between the bottom block 4 and the top nozzle 7. The clearance usually is about 5 mm. Then, the top nozzle coated with the mortar is inserted into the bore 6 and bonded to the releasing agent coated in advance on the inner wall of the bore 6. It should be noted that the releasing agent of this invention can be coated on even a hot refractory block heated up to about 800° C. as well as on a cool refractory block. Further, the thickness of the releasing agent layer at the coating time remains substantially constant after fully dried.

Heat of the molten metal flowing through the top nozzle 7 is transmitted to the layer of the releasing agent 9, resulting in expansion of the releasing agent layer. The expansion is advantageous in that the top nozzle is tightly fixed to the refractory block while a molding operation is being carried out. Also, the polysaccharide contained in at least the surface region of the releasing agent layer is carbonized by the heat transmitted from the molten metal, rendering the releasing agent less adhesive. This facilitates the removal of the nozzle after the molding operation. It should also be noted that the expanded releasing agent layer is contracted to its original thickness after the molding operation and cooling, resulting in that clearance tends to be formed at the boundary between the mortar layer 10 and the layer of the releasing agent 9. Further, the graphite contained in the releasing agent exhibits lubricity. It follows that the nozzle 7 can be readily withdrawn from the nozzle-receiving bore 6 after the molding operation by applying a slight impulse and a pulling force as small as 0.5 $kg/cm^2$ to 1 $kg/cm^2$.

This invention will be more fully understood from the following Example.

EXAMPLE

Eight (8) parts by weight of potato starch was added to 70 parts by weight of water and sufficiently stirred at 55° C. to 60° C. The resultant viscous solution was mixed with 20 parts by weight of graphite powder having a particle size of 1$\mu$ to 2$\mu$. The mixture was fully mixed to prepare a releasing agent.

The releasing agent was coated on the inner wall of a nozzle-receiving bore equivalent to the bore 6 of FIG. 1 so as to provide a layer having a thickness of 1 mm to 2 mm. On the other hand, a mortar consisting of 75.7 parts by weight of $Al_2O_3$, 19.2 parts by weight of $SiO_2$ and 1 part by weight of $Fe_2O_3$ mixed with water was coated on the outer circumference of a nozzle equivalent to the nozzle 7 having a height of 350 mm and the largest diameter of 200 mm as shown in FIG. 2 to provide a mortar layer having a thickness of 3 mm to 4 mm. The nozzle coated with the mortar was inserted into the bore and bonded to the inner wall thereof.

Molten iron was poured through the nozzle several times and, then, the nozzle was taken out of the bore by applying a slight impulse and a total pulling force as small as about 4 tons.

For the purpose of comparison, a nozzle coated with the same mortar as above was inserted into a nozzle-receiving bore having the inner wall not coated with the releasing agent. After the same molding operation as above, the nozzle was taken out of the bore. In this case, a total pulling force as large as about 50 tons was required for taking out the nozzle.

What is claimed is:

1. A ladle having a nozzle-receiving bore, wherein said bore is coated with the releasing agent comprising graphite powder in an amount sufficient for imparting lubricity to the releasing agent, water and at least one kind of water-soluble and gelatinizable polysaccharide dissolved in the water in an amount sufficient for gelatinizing the releasing agent so as to impart coating capability and adhesiveness to the receiving agent and wherein a refractory nozzle is inserted into said nozzle-receiving bore so as to be in contact with said releasing agent.

2. In a ladle for containing molten metal, said ladle having an outlet therein and a refractory nozzle for insertion into a nozzle-receiving bore included in said outlet, said nozzle and said bore being constructed and arranged to define a clearance between said nozzle and said bore when said nozzle has been inserted into the bore, the improvement which comprises:

a releasing agent layer comprising the releasing agent coated within said clearance, wherein said releasing agent comprises graphite powder in an amount sufficient for imparting lubricity to the releasing agent, water and at least one kind of water-soluble and gelatinizable polysaccharide dissolved in the water in an amount sufficient for gelatinizing the releasing agent so as to impart coating capability and adhesiveness to the releasing agent.

3. A ladle according to claim 2 wherein said releasing agent layer has been fully dried by heat and carbonized by the heat of the molten metal flowing through said refractory nozzle.

4. A ladle according to claim 2 with the refractory nozzle removeably inserted into said bore, the removeability of which is facilitated by said releasing agent layer, which releasing agent layer has been fully dried and carbonized with heat, whereby the pulling force needed to remove the refractory nozzle is smaller than 5 $Kg/cm^2$.

* * * * *